United States Patent [19]

Bookvich

[11] Patent Number: 4,616,551

[45] Date of Patent: Oct. 14, 1986

[54] NADA DRUM AND ASSEMBLY

[76] Inventor: Steven Bookvich, 5300 Walnut, Apt. 2, Oakland, Calif. 94616

[21] Appl. No.: 677,366

[22] Filed: Dec. 3, 1984

[51] Int. Cl.[4] ..... G10D 13/02

[52] U.S. Cl. ..... 84/411 A; 84/421

[58] Field of Search ..... 84/411 R, 412, 411 A, 84/413, 419, 420, 421

[56] References Cited

U.S. PATENT DOCUMENTS

| | | | |
|---|---|---|---|
| 2,074,193 | 3/1937 | Strupe | 84/411 A |
| 2,204,987 | 6/1940 | Gussak | 84/412 |
| 3,185,013 | 5/1965 | Gussak | 84/413 |
| 4,077,297 | 3/1978 | Woodson | 84/411 R |
| 4,475,434 | 10/1984 | Willis | 84/411 R |

*Primary Examiner*—L. T. Hix
*Assistant Examiner*—Brian W. Brown
*Attorney, Agent, or Firm*—Joseph J. Goluban

[57] ABSTRACT

A musical instrument having two drum heads of different size and tone quality, with a plurality of tension straps used to vary the drum pitch of one or both of the drum heads during its operation. The instrument is supported on a specially adapted stand with mechanical constricting means which allows the operator to constrict the drum tension straps by means of a foot pedal leaving the operator's hands free to play the two drum heads. The tension straps are connected to a floating suspension ring which allows the drum operator to easily and quickly remove a damaged drum head should the drum head become defective during its operation, without the necessity of removing any of the drum tension straps. The musical instrument may also be used by an operator separate from the drum stand, by means of a shoulder strap. The use of a shoulder strap allows the drum operator to be ambulatory during the drums operation. The operator can play the musical instrument either separately or together and vary their pitch by constricting the drum tension straps by use of the operator's arm pressure instead of the mechanical means provided on the specially adapted drum stand.

27 Claims, 20 Drawing Figures

FIG. 2
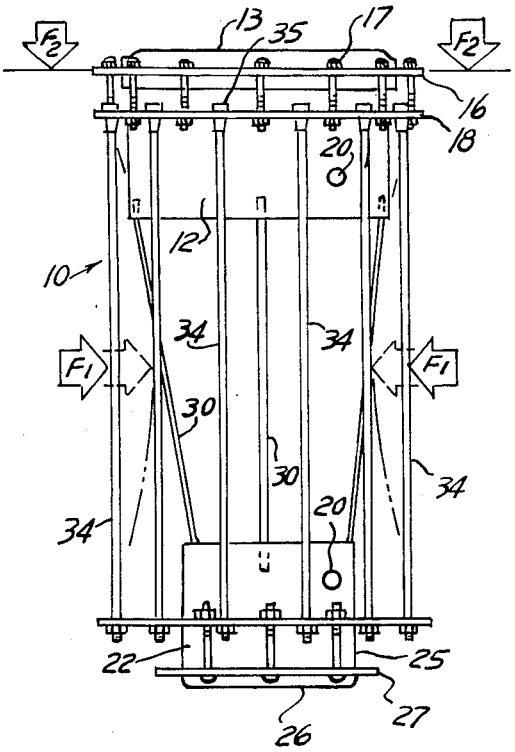
FIG. 4
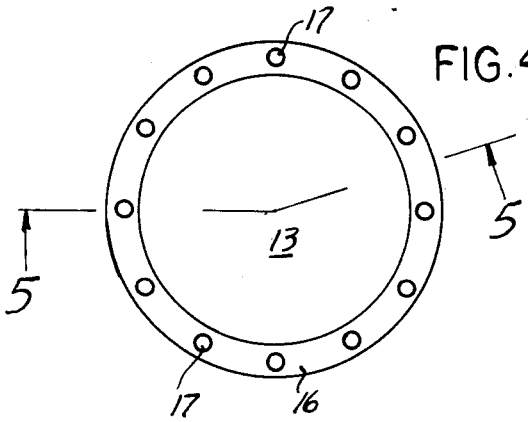
FIG. 5
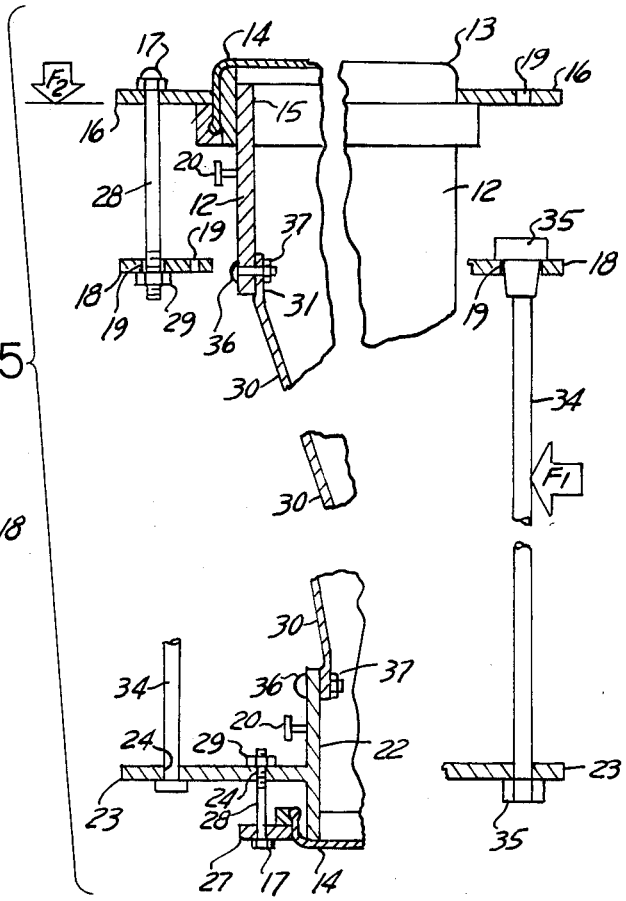
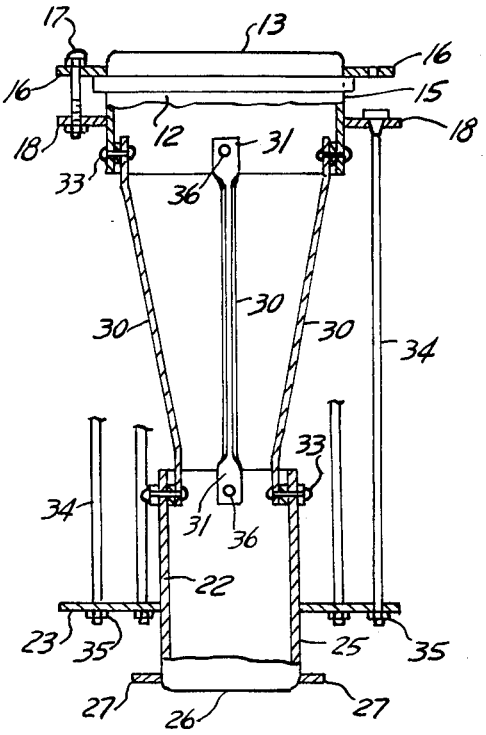
FIG. 3
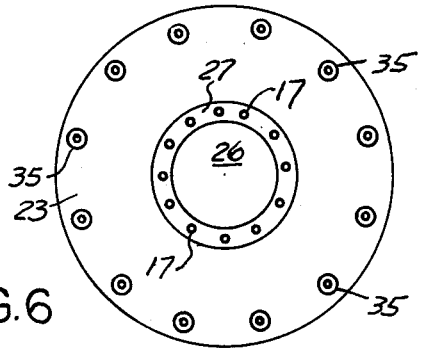
FIG. 6

FIG. 11
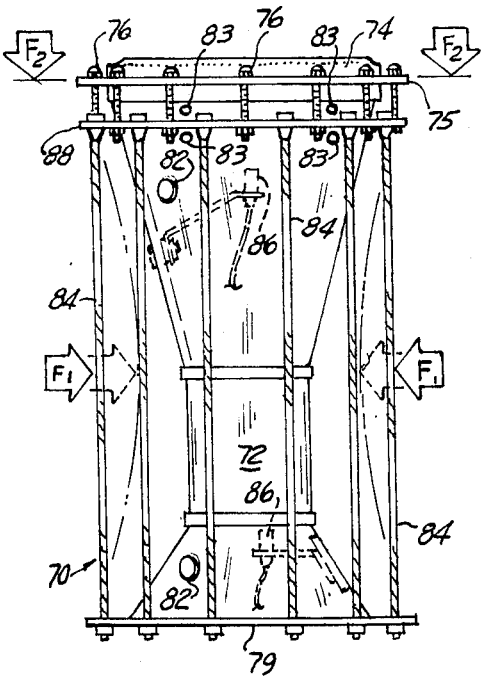
FIG. 12
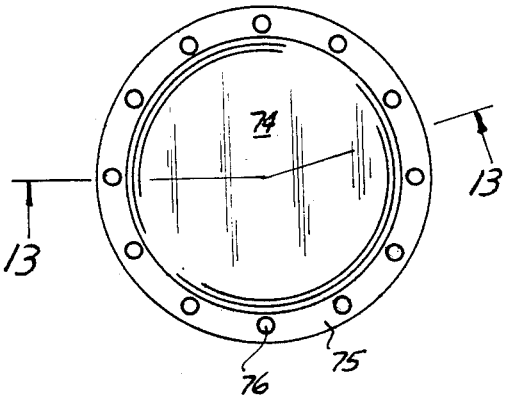
FIG. 13
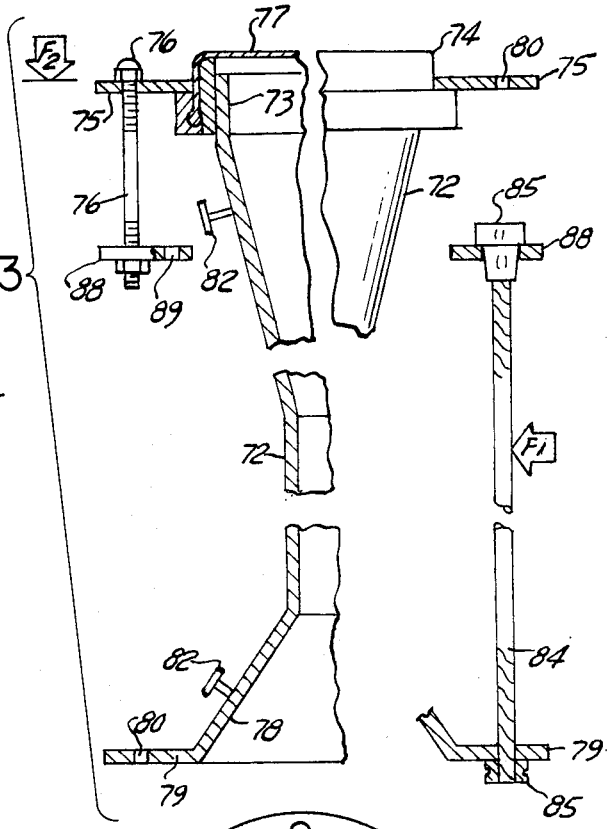
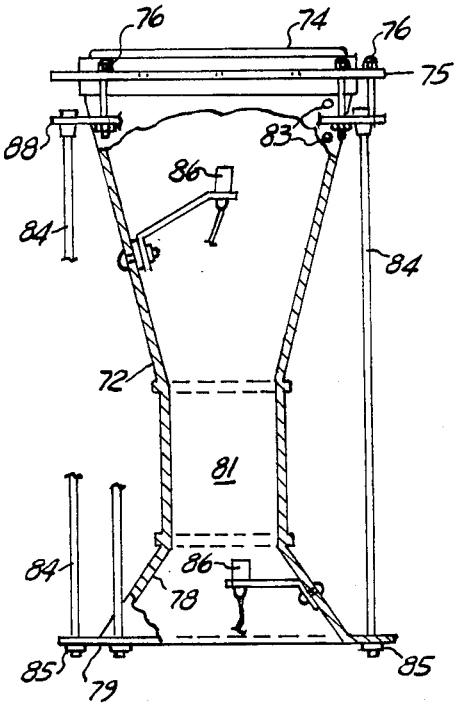
FIG. 15
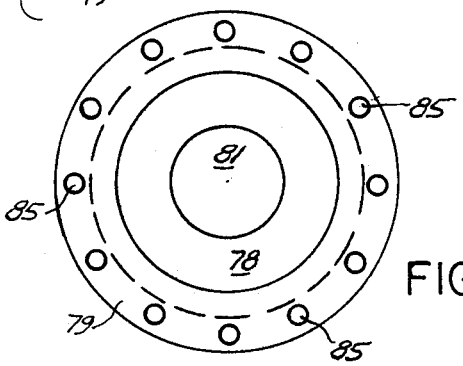
FIG. 14

NADA DRUM AND ASSEMBLY

BACKGROUND OF THE INVENTION

1. Field of the Invention

This invention relates to a new and useful improvement in an adjustable pitch drum and more particularly to a device with two drum heads having tension means to vary the drum pitch of one or both of the drum heads during its operation. The device is supported on a specially adapted drum stand which allows the operator to play both drum heads at the same time. The tension means comprises a novel floating suspension ring attached to a plurarity of tension straps which are used to increase the drum's skin tension. The operator may constrict the tension straps by use of a mechanical constricting device provided with the specially adapted drum stand or manually by use of the operator's arm.

The novel floating suspension ring allows the drum operator to easily and quickly remove a damaged drum head should the drum head become defective during its operation, without the necessity of removing any of the drum tension straps.

2. Brief Description of the Prior Art

Conventional prior art drums utilizing a hollow drum shell having drum heads held in place by head rims which allows only limited adjustment of the drum tone or pitch.

Complicated mechanical devices with many disadvantages associated therewith have been constructed which allow the drum heads to be individually tensioned. One such device is U.S. Pat. No. 2,074,193 issued to C. H. Strupe which shows the use of a very complicated mechanical means for tensing the drum's head. The disadvantage associated with said device is for example, that there is no way of quickly and easily changing the drum skin should it be necessary during a performance. Also, this prior art device does not allow the use of different size drum heads nor can it be played as an African Talking Drum, tom-tom or a bongo drum in an ambulatory manner. In accordance with the present invention it has been found that it is quite desirable to provide for a change of tone or pitch by providing a dual drum head construction which can be played in a fixed or ambulatory manner having a simplified method of adjusting the drum tone or pitch.

One such simplified prior art device is U.S. Pat. No. 3,185,013 issued to William Gussak which shows the use of a tom-tom or a bongo drum style construction utilizing tension cords. The tension cords of this prior art device extends between the drum heads over loops located on the drum heads retainer loop. This prior art device is capable of being played by the use of a special gripping means which facilitate the holding of the drum during its use as either a tom-tom or a bongo drum. However, said prior art device has certain disadvantages associated therewith being that the tension cords used to vary the drum tone or pitch must be completely removed before the drum head skin can be replaced. Further, the object of said prior art device is to provide an improved drum construction having a special gripping means for holding the drum between the player's knees or under one arm, where as, the object of the present invention is to provide an improved drum construction utilizing two different size drum heads, with means for varing the drum heads pitch and tone; said means allowing an easy and quick removal of a defective drum head, without the necessity of removing any of the tension cords. Unlike the Gussak device my invention can be played in either a stationary or ambulatory manner.

BRIEF SUMMARY OF THE INVENTION

Accordingly, one object of the present invention is to provide an improved drum having adjustable means for varying the drum pitch.

Another object of the present invention is to provide an adjustable pitch drum having tension straps which do not have to be removed when replacing the drum head.

Another object of the present invention is to provide an improved adjustable pitch drum having either a single or dual drum head construction.

Another object of the present invention is to provide an improved adjustable pitch drum having either an open or solid frame drum shell construction.

Still another object of the present invention is to provide an improved adjustable pitch drum having a floating suspension ring, to which the tension straps and drum head rims are attached, which allows an easy and quick replacement of the drum head.

Still another object of the present invention is to provide an improved adjustable pitch drum which can be played either on a fixed type drum stand or body held by the drum operator.

Still a further object of the present invention is to provide an improved adjustable pitch drum which allows the blending of two different drum tones directly in front of the drummer by use of an open frame drum shell construction.

Still a further object of the present invention is to provide an improved adjustable pitch drum in combination with a specially adapted drum support assembly which allows the drummer to constrict the drum tension straps of said adjustable pitch drum by means of a foot pedal.

Still a further object of the present invention is to provide an improved drum support assembly having constricting means to constrict the drum tension straps of an adjustable pitch drum.

Still a further object of the present invention is to provide an improved adjustable pitch drum which can be held by the drum operator using only a shoulder strap.

Still a further object of the present invention is to provide an improved dual drum which allows the blending of two different drum tones directly in front of the drummer by use of an open frame drum shell construction.

To accomplish the foregoing and other objects of this invention there is provided an improved adjustable pitch drum that is relatively simply in construction, that can be played with two different heads at the same time, that can be hand held or affixed to a drum stand, and that has a floating suspension ring which allows the easy and quick removal of the drum head without the necessity of disassembling the tension straps used to vary the drum pitch.

Further objects and advantages of my invention will be apparent from the following description and appended claims, reference being made to the accompanying drawings forming a part of this specification, wherein like reference characters designate corresponding parts in the several views.

BRIEF DESCRIPTION OF THE DRAWINGS

The invention is illustrated in the accompanying drawings, wherein:

FIG. 2 is an elevational view of an adjustable pitch drum utilizing an open frame shell construction having two drum heads.

FIG. 3 is a partial sectional elevational view of my invention, as shown in FIG. 2.

FIG. 4 is a plan view of my invention as shown in FIG. 2.

FIG. 5 is a partial framentary sectional view taken in the direction of the arrows on the section line 5—5 of FIG. 4.

FIG. 6 is a bottom view of my invention as shown in FIG. 2.

FIG. 11 is an elevational view of an adjustable pitch drum utilizing a solid frame shell construction having one drum head.

FIG. 12 is a plan view of my invention as shown in FIG. 11.

FIG. 13 is a partial fragmentary sectional view taken in the direction of the arrows on the section line 13—13 of FIG. 12.

FIG. 14 is a bottom view of my invention as shown in FIG. 11.

FIG. 15 is a partial, sectional elevational view of my invention as shown in FIG. 11.

It is to be understood that the present invention is not limited in its application to the details of construction and arrangement of parts illustrated in the accompanying drawings, since the invention is capable of other embodiments and of being practiced or carried out in various ways within the scope of the claims. also, it is to be understood that the phraseology and terminology employed herein is for the purpose of description and not of limitation.

DESCRIPTION OF THE PREFERRED EMBODIMENT

Figure 1:
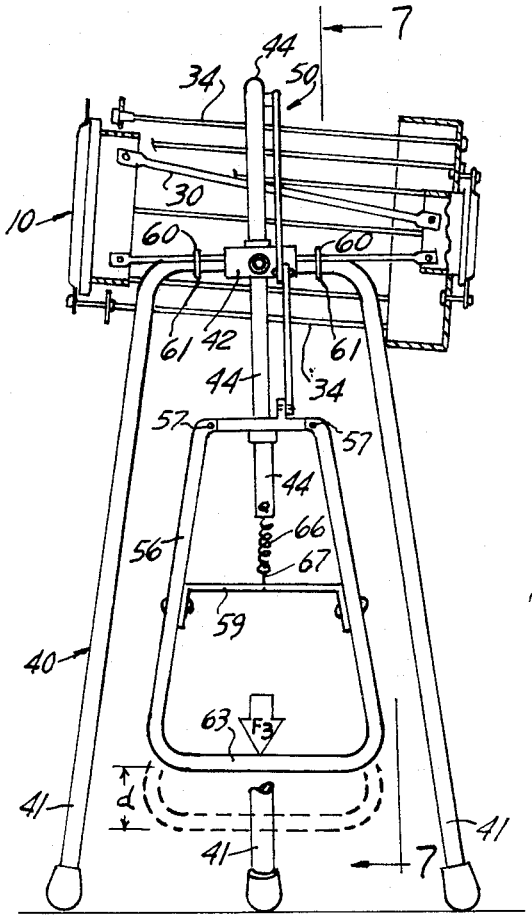
FIG. 1 is an elevational view of an adjustable pitch drum and drum support assembly.

As my preferred embodiment I have shown in FIG. 1, of the drawings my unitary musical instrument as an adjustable pitch drum 10 in combination with a drum support assembly 40.

The adjustable pitch drum 10 can be best seen by reference to FIGS. 2 through 6 of the drawings which show my invention as having an open cylindrical frame shell construction. The drum shell consists of a large shell 12 and small shell 22 which are cooperatively connected by means of a plurality of support bars 30. The support bars 30 are connnected to both the large shell 12 and small shell 22 by standard connecting means 33,such as, machine screws 36 and nuts 37 placed through holes (not shown) located in the stem 31 portion of the support bars 30 and the large and small shells.

Intermediate on the small shell 22 as best seen in FIGS. 3, 5 and 6 is a flat disk 23 portion which is an integral part thereof. The flat disk 23 has a plurality of holes 24 concentrically located near both the outside and inside perimeter of the flat disk 23, with a greater diameter than the outside diameter of the large shell 12. The small shell 22 can be constructed from any of the standard type material used for drum construction and as my preferred embodiment I wish to disclose the use of Plexiglas.

Over the protruding end 25 of the small cylindrical shell 22 is disposed a small drum head 26 of standard type construction, such as, a Remo, Weather King, Rockers or Ludwig brand. The small drum head 26 is held in place on the protruding end 25 by means of the small head rim 27 that has a plurality of holes 24 which can cooperatively accept the attaching means 17.

Figure 20:
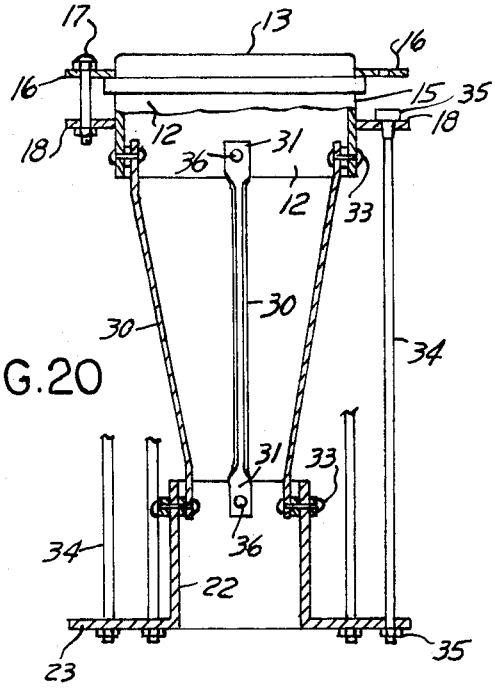
FIG. 20 is a partial, sectional elevational view of an adjustable pitch drum utilizing an open frame shell construction having one drum head.

The head rim 27 is secured to the flat disk 23 portion of the small shell 22 by means of a plurality of attaching means 17, such as a standard type latch hook (not shown) or machine bolts 28 and nuts 29 as can be best seen in FIG. 5. While I have shown as my preferred embodiment the use of a small drum head 26 with no means for varying its pitch. However, it should be clearly understood that it is possible to provide the small drum head 26 with means to vary its pitch similar to that of the large drum head 13 as will be later explained. It should also be understood that it is possible to vary the size of the small drum head 26 from what is shown of the drawings within the scope of the invention or simply completely eliminating the small drum head 26 altogether, as can be best seen in FIG. 20.

Referring now to FIGS. 2 and 4 which show an elevational and plan view of the large shell 12 respectively. The large shell 12 like the small rum shell 22 can be constructed from any of the many standard type materials used for drum construction, such as, Plexiglas. Over the outside end 15 of the large shell 12 is disposed a large drum head 13 of standard type construction, such as, a Remo, Weather King, Rocker or Ludwig brand. The large drum head 13 is held in place by means of a large head rim 16. While the head rim 16 being securely held in place over the large drum head 13 by a plurality of attaching means 17 which are cooperatively connected to the head rim 16 and the floating suspension ring 18. The head rim 16 has a plurality of holes 19 which are designed to cooperatively accept the attaching means 17. As part of my preferred embodiment I wish to disclose the use of attaching means 17 such as a standard type latch hook (not shown) or machine screws 28 and nut 29 (as shown).

The floating suspension ring 18, as can best be seen in FIGS. 2 and 5 of the drawings, is designed so that its inside diameter is larger than the outside diameter of the large shell 12. While its outside diameter is at least as large as the outside diameter of the flat disk 23 so that the tension straps 34 are parallel to the longitudinal axis of the adjustable pitch drum 10. As in the case of the flat disk 23 there is disposed a plurality of holes 19 concentrically located near both the outside and inside perimeter of the floating suspension ring 18 which cooperatively accepts both the tension straps 34 and the attaching means 17.

The tension straps 34 are disposed between the flat disk 23 and the floating suspension ring 18, as explained above, in a concentric parallel configuration due to the outside diameter of both the flat disk 23 and the floating suspension ring 18 being of the same size. The tension straps 34 are permanently connected to the floating suspension ring 18 and the flat disk 23 by any of the many standard connecting means 33 known in the art, such as, knotting, hooks or clamps. While the tension straps 34 can be made of any of the standard type nonelastic materials known in the art, I wish to disclose as part of my preferred embodiment the use of a nylon material for the tension straps 34.

It can be appreciated that once the adjustable pitch drum 10 is assembled as above described; it is possible to vary the large drum head skin 14 tension by the application of a constricting Force-1 on the tension straps 34 either manually or mechanically, as can be best seen in FIGS. 2 and 5. The displacement of the tension straps 34, as shown in FIG. 2 by the phantom lines and force arrows causes a Force-2 which in turn makes both the floating suspension ring 18 and the large rim head 16 move towards the flat disk 23 since they are cooperatively connected by attaching means 17. As the large rim head 16 is displaced towards the opposite end of the adjustable pitch drum 10 it will cause a tightening of the large drum head skin 14.

It can also be appreciated that the sound made by my adjustable pitch drum 10 with its deep tone large drum head 13 as the constricting of the tension straps 34 occurs, causes a pitch that varies from a point of tone rather than a point of non-tone. Further, the combination of the deep tone and the high tone produced by the small drum head 26 results in a pleasing variation of sounds which blend together in front of the drum player due to the open frame shell construction of my device.

It should also be understood that the tones produced by my adjustable pitch drum 10 may be enhanced by the use of standard type electrical devices, such as: regular microphones 86, contact mircophones and built in battery powered mobile speakers which may be easily attached to said drum.

Thus, it can be also appreciated that should the large drum head 13 become defective during its operation, it can be quickly and easily replaced without the necessity of removing any of the tension straps 34, by simply disengaging the attaching means 17 from the floating suspension ring 18, and removing both the large head rim 16 and the large drum head 13 from the large shell 12. Conversely, should the small drum head 26 become defective during its operation it can also be quickly and easily replaced without the necessity of removing any of the tension straps 34, by simply disengaging the attaching means 17 from the flat disk 23 and removing both the small head rim 27 and the small drum head 26 from the small shell 22.

Located on the outside surface on both the large and small shells are suitably disposed shoulder strap attaching hooks 20 which are used by the drum player to hold the adjustable pitch drum 10 when it is used in an ambulatory manner. Also, located on the large shell 12 are ring supports 83 which hold the floating suspension ring 18 in place when the drum head 13 is removed and replaced, thus preventing the tangling of the tension straps 34.

As part of my preferred embodiment I also wish to disclose the use of a novel drum support assembly 40 in combination with the adjustable pitch drum 10. The drum support assembly 40 besides supporting the adjustable pitch drum 10 in a horizontal position can also be used to mechanically constrict the tension straps 34 during the drum operation by means of a foot pedal 63 located underneath said support assembly 40. The use of the drum support assembly 40 frees the drummer's hands to play both drum heads at the same time, thus enhancing the drum sound produced during the blending of the high and low tones.

Figure 9:
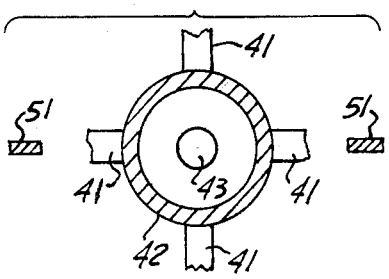
FIG. 9 is a sectional view taken in the direction of the arrows on the section line 9—9 of FIG. 7.

The drum support assembly 40, as can be best seen in FIGS. 1 and 7 to 10 is supported by a minimum of three legs 41 that are connected to the base plate 42, although, as part of my preferred embodiment I wish to disclose the use of four legs 41. The base plate 42 has a machine threaded hole 43 at its center, as best seen in FIG. 9 into which a threaded hollow stem 44 is disposed. The adjustable pitch drum 10 is placed on the top of the base plate 42 and is secured in place by means of any standard locking device, such as, a U clamp 60 and plate 61. The locking device is assembled by placing the machine threaded U clamp 60 over the drum support assembly leg 41 and the drum support bar 30 which is secured thereon by means of a nut 62 after the plate 61 is placed over the threaded ends of the U clamp 60. In my preferred embodiment, I have disclosed the use of two such locking devices.

Figure 10:
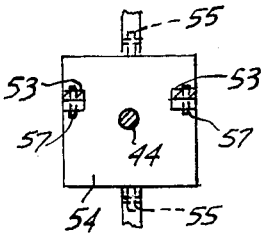
FIG. 10 is a sectional view taken in the direction of the arrows on the section line 10—10 of FIG. 7.
Figure 7:
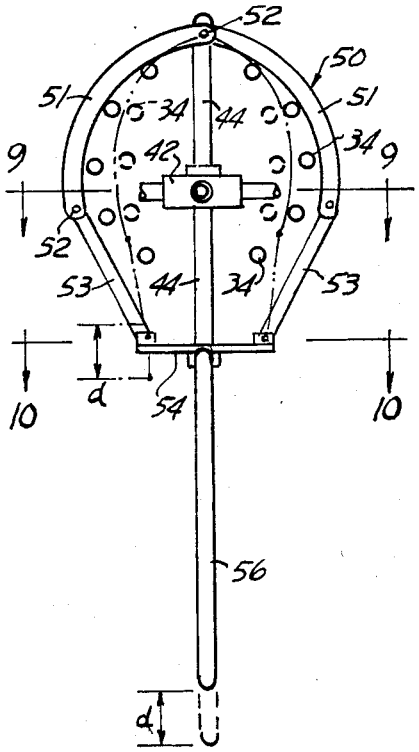
FIG. 7 is a side view of the constricting mechanism of the drum support assembly taken in the direction of the arrows on the section line 7—7 of FIG. 1.
Figure 8:
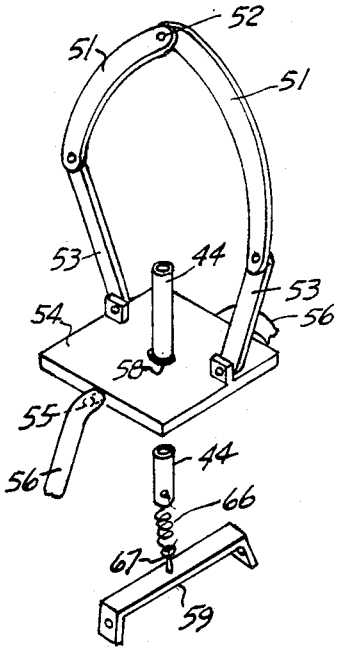
FIG. 8 is a partial fragmentary perspective view of FIG. 7.

Once, the adjustable pitch drum 10 has been attached to the drum support assembly 40 the constricting mechanism 50 is disposed over the drum tension straps 34. Reference to FIGS. 1 and 7 of the drawings shows the constricting mechanism 50 comprising two identical arc braces 51 which are pivotally connected at their top by suitable means, such as, machine screws and nut 52. While the opposite end of both arc braces 51 are pivotally connected to straight braces 53 by suitable means, such as, machine screw and nut 52, the other end of the straight braces 53 are also pivotally connected to opposite sides of an anchor plate 54 by suitable means, such as, machine screws and nuts 52. Located on the opposite sides of the anchor plate 54, as best seen in FIG. 10, are stubs 55 which can accommodate the hollow ends of the U tube 56. Once the ends of the U tube 56 are disposed over the end of the stubs 55 it can be secured in place by means of a cotter pin (not shown) which are placed into the hole (not shown) located in both stubs 55 and the ends of the U tube 56.

Next the anchor plate 54 is urged over the stem 44 through the hole 58 located at its center. Once the anchor plate 54 is disposed over said stem 44 it is pivotally connected to the end of the straight braces 53 and a spring 66 is attached to the lower end of the stem 44 and eye hook 67. The eye hook 67 being intermediately located on a bracket 59 which is connected to the inside perimeter of U tube 56 by suitable means (not shown), such as, machine screws and nuts. The lower end of the spring 66 can be easily connected or disconnected from the eye hook 67 located at the center of bracket 59.

Referring now to FIG. 7 it can be seen that a downwardly Force—3, as depicted by the force arrow on the foot pedal 63 portion of the constricting mechanism 50 will cause a downward displacement of "d" of the anchor plate 54 as it moves along stem 44, which will in turn cause the downwardly and inwardly movement of both braces 51 and 53. As the braces 51 and 53 move they will in turn case the tension straps 34 of the adjustable pitch drum 10 to constrict, as depicted by the phantom lines which illustrate both the straps and braces, since the braces and the anchor plate 54 are pivotally connected to each other. Therfore, once the adjustable pitch drum 10 is connected to the drum support assembly 40 the drum operator is free to play the unitary musical instrument with both hands and can constrict the drum tension straps 34 by means of the foot pedal 63 portion of the drum support assembly 40 to produce the required pitch or tone variations during the drums operation.

While I have shown as my preferred embodiment a unitary musical instrument consisting of an adjustable pitch drum 10 in combination with a drum support assembly 40 it should be clearly understood that my adjustable pitch 10 can be used separately from the drum support assembly 40 by simply attaching a shoulder strap (not shown) to the attaching hook 20 located on the outside surface of the large and small rum shells. Thus allowing the drum operator to play the adjustable pitch drum 10 in an ambulatory manner while using only the shoulder strap as a supporting means.

Thus, I have invented a novel musical instrument having an improved adjustable pitch drum 10 which allows the blending of two different drum tones directly in front of the drummer by use of an open frame large and small shell construction. Further, my invention has a novel adjustment means to varying the drum pitch by use of the tension straps 34 which do not have to be removed when replacing the large drum head 13 due to the drums improved construction which utilizies a novel floating suspension ring 18. The floating suspension ring 18 can be easily disconnected or connected to the large head rim 16 by the attaching means 17 without the necessity of removing any of the tension straps 34 or being removed from the drum support assembly 40. Thus, my novel invention may be played either in combination with a drum support assembly 40 or body held by the drum operator.

While I have shown as my preferred embodiment of my invention a musical instrument having two drum heads with an open frame shell construction; I now also wish to disclose an improved adjustable pitch drum 70 having only one drum head with a solid frame shell construction, as can be best seen by referring to FIGS. 11 through 15 of the drawings.

The adjustable pitch drum 70 has a solid frame shell 72 construction with an open end 73 and a base end 78. The drum shell 72 can be constructed of any of the standard type materials used for drum construction, however, I wish to disclose the use of a transparent type Plexiglas material. Located at the base end 78 of the drum shell 72 is an integral flat disk 79 which performs two functions. First, it can be used as a base to set the adjustment pitch drum 70 on when the drum operator wishes to play the drum in a vertical position, thus eliminating the necessity of holding it. Second, the flat disk 79 is used to attach the tension straps 84 by inserting through a plurality of holes 80 located near the outside perimeter of flat disk 79. The disk 79 is designed to be of a greater diameter than the outside diameter of the open end 73 portion of the drum shell 72.

While I have shown the flat disk 79 to be an integral part of the drum shell 72 with an opening 81 located therein, it should also be understood, that it is possible to construct the flat disk 79 without the opening 81.

Located at the open end 73 of the drum shell 72 is drum head 74 of a standard type construction, as above described in this specification, which is held in place by means of a head rim 75. The head rim 75 is held in place by a plurality of attaching means 76, such as a standard type latch hook (not shown) or machine screws and bolts (as shown) which can be easily connected to or disconnected from the floating suspension ring 88.

The floating suspension ring 88, as can best be seen in FIGS. 11 and 13 of the drawings, is designed so that its inside diameter is larger than the outside diameter of the shell 72, while its outside diameter is at least as large as the outside diameter of the flat disk 79. As in the case of the flat disk 79 the floating suspension ring 88 has a plurality of holes 89 located thereon which cooperatively accepts the tension straps 84 that are disposed between the flat disk 79 and the flating suspension ring 88 in a parallel configuration for reasons above described in this specification. The tension straps 84 can be made of any nonelastic type material, such as nylon.

The drum head skin 77 tension can be varied by the constriction of the tension straps 84, due to a force created by the drummer's arm pressure instead of the mechanical means provided by the drum support assembly 40. As can be best seen by reference to FIGS. 11 and 13 of the drawings the drummer's arm pressure as shown as F 1 on the tension straps 84 causes the tension straps to displace inwardly (as depicted by the phantom lines) toward the drum shell 82, which in turn causes a force F 2 to act on both the floating suspension ring 88 and on the drum head rim 75. The displacement of the drum head rim 75 in a downwardly direction towards the flat disk 79, causes the drum skin 77 to tighten and produce a variation in the drum pitch and tone during its operation. Thus, the variation of the drum skin 77 tension by constricting the tension straps 84 provides a novel means for varying the drum 70 pitch.

It can be further appreciated that the use of a floating suspension ring 88 allows the drum operator to easily and quickly remove, as above described in this specification, the drum head 74 should it be desirable to replace the drum head 14 during a performance, without the necessity of removing any of the drum tension straps 84. Besides the need to change a drum head 74 in the event of a drum skin 77 failure, it may also be desirable to have a drum head replaced with a head that produces a different tone during the performance.

The adjustable pitch drum 70 can be used in an ambulatory manner by the drummer with a shoulder strap (not shown) being attached to shoulder strap hooks 82 located on the outer surface of drum shell 72 near its opposite ends.

I now wish to disclose still another embodiment of the present invention besides the adjustable pitch drums 10 and 70 which I above described as having either a dual drum head or single drum head construction with means for variation of the drum tone. It is also possible to use an open frame drum shell construction with a dual drum that does not have any means for variation of the drum pitch or tone.

Figure 16:
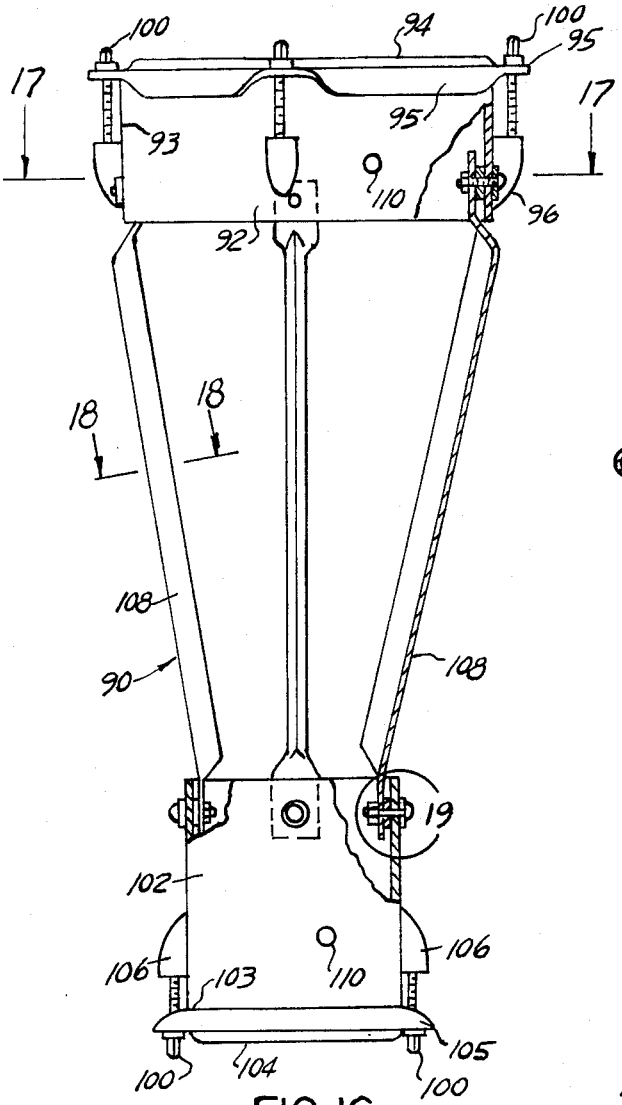
FIG. 16 is an elevational view partially, in section, of a dual drum utilizing an open frame shell construction.
Figure 19:
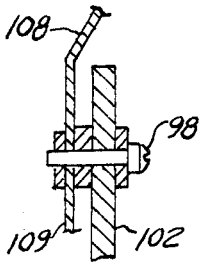
FIG. 19 is an enlarged fragmentary sectional view of FIG. 16, as identified by circle 19.
Figure 17:
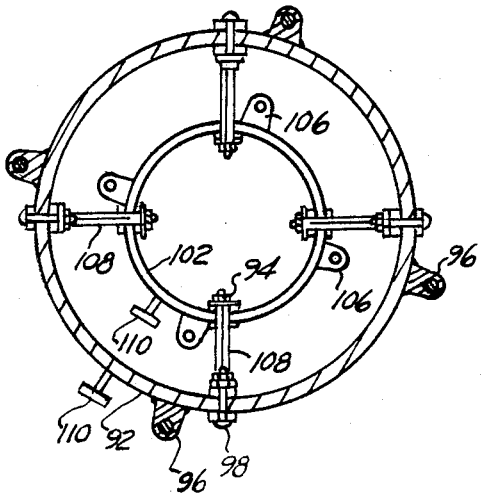
FIG. 17 is a sectional view taken in the direction of the arrows on the section line 17—17 of FIG. 16.
Figure 18:
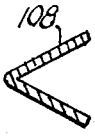
FIG. 18 is a sectional view taken in the direction of the arrows on the section line 18—18 of FIG. 16.

Referring now to FIGS. 16 and 19, I wish to disclose an embodiment of my invention being constructed without the use of any drum head skin tension means. The dual drum 90 has a cylindrical large shell 92 and a small shell 102 which are cooperatively connected by means of support bars 108. The support bars 108 as best seen in FIG. 19 are suitably connected to both the large shell 92 and small shell 102 by attaching means, such as, a standard type machine screw and nut 98. The attaching means are placed through holes (not shown) located in both the stem 109 portion of the support bars 108 and the cylindrical shell frame. While the design shape of the support bars is not critical, I wish to disclose the use of a V channel construction.

Over the end 103 of the small shell 102 is disposed a small drum head 104 of a standard type construction, as above described, which is held in place by means of a small head rim 105. The small head rim 104 is affixed to the end 103 of the small shell 102 by means of a plurality of anchor bolts 100 which are screwed into the lip 106 portion of the small shell 102. At the end 93 of the large shell 92 is disposed a large drum head 94 of a standard type construction which is held in place by means of a large head rim 95. The large head rim 95 is affixed to the end 93 of the large shell 92 by means of a plurality of anchor bolts 100 which are screwed into the lip portion 96 of the large shell 92.

It can be appreciated that my dual drum 90 when played by the drummer allows the blending of the two different drum tones directly in front of the drummer, due to its open frame shell construction. Like the other embodiments of my invention the dual drum 90 can be used in either an ambulatory manner by the drummer with the aid of shoulder straps (not shown) which can be attached to hooks 110, or attached to a drum supporting stand.

Thus, by abandoning the previous construction used for adjustable and nonadjustable pitch drums, I have invented an improved musical instrument which is simple, practical, economical and attractive in appearance.

I claim:

1. An adjustable pitch drum having a dual drum shell, comprising:

a large shell having an outside end;

a small shell having an integral flat disk portion and a protruding end;

support bars having a stem portion located at both ends, the stem portion of said support bars being affixed at one end to said small shell and at the opposite end to said large shell by fastening means;

a small drum head, said small drum head being disposed over the protruding end of said small shell;

a small head rim, said small head rim being disposed over said small drum head and cooperatively connected to the flat disk portion of said small shell by attaching means;

a large drum head, said large drum head being disposed over the outside end of said large shell;

a large head rim, said large head rim being disposed over said large drum head;

a floating suspension ring, said floating suspension ring being positioned between said large head rim and the flat disk portion of said small shell and cooperatively connected to said large head rim by attaching means; and tension straps, said tension straps being affixed to said floating suspension ring and the flat disk portion of said small shell by connecting means;

whereby, said large drum head can be replaced without disconnecting any of said tension straps.

2. An adjustable pitch drum having a dual drum shell, comprising:

a large shell having an outside end;

a small shell having an integral flat disk portion and a protruding end, the flat disk portion having a plurality of holes;

support bars having a stem portion located at both ends, said support bars being intermediately positioned between said large shell and said small shell, the stem portion of said support bars being affixed at one end to said small shell and at the opposite end to said large shell by fastening means;

a small drum head, said small drum head being disposed over the protruding end of said small shell;

a small head rim having a plurality of holes, said small head rim being disposed over said small drum head and held in place by attaching means, the attaching means being disposed through the plurality of holes located in said small head rim and the flat disk portion of said small shell;

a large drum head, said large drum head being disposed over the outside end of said large shell;

a large head rim having a plurality of holes, said large head rim being disposed over said large drum head and held in place by attaching means;

a floating suspension ring having a plurality of holes, said floating suspension ring being positioned between said large head rim and the flat disk portion of said small shell and held in place by attaching means, the attaching means being disposed through the plurality of holes located in said large head rim and the flat disk portion of said small shell; and tension straps, said tension straps being disposed between said floating suspension ring and the flat disk portion of said small shell, said tension straps being connected at one end to said floating suspension ring through the plurality of holes located therein and at the opposite end to the flat disk portion of said small shell through the plurality of holes located therein and held in place by connecting means;

whereby said large drum head can be removed by disconnecting the attaching means from said floating suspension ring without the necessity of removing said tension straps.

3. An adjustable pitch drum described in claim 2, wherein said floating suspension ring outside diameter is as large as the outside diameter of the flat disk portion of said small shell and the plurality of holes of said floating suspension ring are concentrically located near both the outside and inside perimeter of said ring.

4. An adjustable pitch drum described in claim 3, wherein said tension straps are aligned in a concentric parallel configuration about said large shell and small shell.

5. An adjustable pitch drum described in claim 4, further comprising a shoulder strap attaching hooks, said attaching hooks being affixed to said large shell and small shell.

6. An adjustable pitch drum described in claim 5, wherein said support bars fastening means comprise machine screws and nuts.

7. An adjustable pitch drum described in claim 6, wherein said support bars comprises four bars.

8. An adjustable pitch drum described in claim 7, wherein said large shell and small shell are constructed from thermoplastic polymer.

9. An adjustable pitch drum described in claim 8, wherein said tension straps are constructed from a nonelastic material.

10. An adjustable pitch drum having a dual drum shell, comprising:

a large shell having an outside end;

a large drum head, said large drum head being disposed over the outside end of said large shell;

a large head rim having a plurality of holes, said head rim being disposed over said large drum head;

a small shell having an integral flat disk portion and protruding end, the flat disk portion having a plurality of holes;

a small drum head, said drum head being disposed over the protruding end of said small shell;

a small head rim having a plurality of holes, said small head being disposed over said small drum head;

support bars having a stem portion at both ends, said support bars being intermediately positioned between said large shell and said small shell, the stem portion of said support bars being affixed at one end to said small shell and at the opposite end to said large shell by the fastening means;

a floating suspension ring having a plurality of holes, said floating suspension ring being positioned between said large head rim and the flat disk portion of said small shell;

tension straps, said tension straps being disposed between said floating suspension ring and the flat disk portion of said small shell, said tension straps being connected at one end to the flat disk portion of said small shell through the plurality of holes located therein and the opposite end of said tension straps being connected to said floating suspension ring through the plurality of holes located therein;

means for attaching said large head rim to said floating suspension ring; and means for attaching said small head rim to the flat disk portion of said small shell;

whereby said large drum can be replaced without removing said tension straps by disconnecting said attaching means located between said large head rim and said floating suspension ring.

11. An adjustable pitch drum described in claim 10, wherein said attaching means comprises a standard type latch hooks.

12. An adjustable pitch drum described in claim 11, wherein said support bars fastening means comprises machine screws and nuts.

13. An adjustable pitch drum described in claim 12, wherein said support bars comprises four bars.

14. An adjustable pitch drum described in claim 13, wherein said large and small shell are constructed from thermoplastic polymer.

15. An adjustable pitch drum described in claim 14, wherein said plurality of tension straps are made with non-elastic material.

16. An adjustable pitch drum described in claim 15, further comprising a shoulder strap attaching hooks, said attaching hooks being affixed to said large shell and small shell.

17. An adjustable pitch drum described in claim 10, wherein said attaching means comprises machine bolts and nuts.

18. An adjustable pitch drum described in claim 17, wherein said support bars fastening means comprises machine screws and nuts.

19. An adjustable pitch drum described in claim 18, wherein said support bars comprises four bars.

20. An adjustable pitch drum described in claim 19 wherein said large and small shells are constructed from thermoplastic polymer.

21. An adjustable pitch drum described in claim 20, wherein said tension straps are made with non-elastic material.

22. An adjustable pitch drum described in claim 21, further comprising a shoulder strap attaching hooks, said attaching hooks being affixed to said large shell and small shell.

23. An adjustable pitch drum having a dual drum shell,comprising:

a shell having an outside end;

a second shell having an integral flat disk portion;

support bars having a stem portion located at both ends thereof, the stem portion of said support bars being affixed at one end of said first shell and at the opposite end to said second shell by fastening means;

a drum head, said drum head being disposed over the outside end of said first shell;

a head rim, said head rim being disposed over said drum head;

a floating suspension ring, said floating suspension ring being positioned between said head rim and the flat disk portion of said second shell and cooperatively connected to said head rim by attaching means; and tension straps, said tension straps being connected to said floating suspension ring and the flat disk portion of said second shell by connecting means;

whereby said drum head can be replaced without removing said tension straps by disconnecting said attaching means located between said head rim and said floating suspension ring.

24. An adjustable pitch drum having a unitary drum shell, comprising:

a shell having an open end and base end;

a drum head, said drum head being disposed over the open end of said shell;

a head rim, said head rim being disposed over said drum head;

a floating suspension ring, said floating suspension ring being positioned between said head rim and the base end of said shell;

means for attaching said head rim to said floatting suspension ring; and tension straps, said tension straps being disposed between said floating suspension ring and the base end of said shell, said tension straps being connected to the base end of said shell and to said floating suspension ring;

whereby said drum head can be replaced without removing said tension straps by disconnecting said attaching means affixed to said head rim and to said floating suspension ring.

25. In combination an adjustable pitch drum having a dual drum shell and drum support assembly, comprising:

a large shell having an outside end;

a large drum head, said drum head being disposed over the outside end of said large shell;

a large head rim being disposed over said large drum head;

a small shell having an integral flat disk portion and protruding end;

a small drum head, said drum head being disposed over the protruding end of said small shell;

a small head rim, said small head rim being disposed over the small drum head and connected to the flat disk portion of said small shell by attaching means;

support bars having a stem portion at each end, said support bars positioned between said large shell and small shell, the stem portion of said support bars being affixed to both said shells by fastening means;

a floating suspension ring, said floating suspension ring being positioned between said large head rim and the flat disk portion of said small shell, said floating suspension ring being connected to said large head rim by attaching means;

tension straps, said tension straps being connected at one end to the flat disk portion of said small shell and at the other end to said floating suspension ring by connecting means; and a drum support assembly, said support bars being mounted to said drum support assembly, said drum support assembly having means for constriction of said tension straps;

whereby said large drum head can be removed by disconnecting said attaching means from said floating suspension ring without the necessity of removing said tension straps or dismounting from said drum support assembly.

26. In combination an adjustable pitch drum having a dual drum shell and drum support assembly, comprising:

a large shell having an outside end;

a small shell having an integral flat disk portion and a protruding end;

support bars having a stem portion located at both ends, the stem portion of said support bars being affixed at one end to said small shell and at the opposite end to said large shell by fastening means;

a small drum head, said small drum head being disposed over the protruding end of said small shell;

a small head rim, said small head rim being disposed over said small drum head and cooperatively connected to the flat disk portion of said small shell by attaching means;

a large drum head, said large drum head being disposed over the outside end of said large shell;

a large head rim, said large head rim being disposed over said large drum head;

a floating suspension ring, said floating suspension ring being positioned between said large head rim and the flat disk portion of said small shell and cooperatively connected to said large head rim by attaching means;

tension straps, said tension straps being connected to said floating suspension ring and the flat disk portion of said small shell by connecting means;

a base plate having a hole at its center; legs, said legs being affixed to said base plate by fastening means;

a stem, said stem being disposed into the hole in said base plate;

means for securing said support bars to said legs; and means for constricting said tension straps;

whereby said constricting means can be used to vary the tone produced by said large drum head by the constricting of said tension straps, further said large drum head can be replaced without removing said tension straps by disconnecting said attaching means affixed to said large head rim and to said floating suspension ring.

27. A dual drum, comprising:

a large shell having an end and a lip portion;

a small shell having an end and a lip portion;

support bars having a stem portion at both ends, said support bars being intermediately positioned between said large shell and said small shell, the stem portion of said support bars being affixed at one end to said small shell and at the opposite end to said large shell by fastening means;

a large drum head, said large drum head being disposed over the end of said large shell;

a large head rim, said large head rim being disposed over said large drum head and being affixed to the end of said large drum shell by fastening means connected to the lip portion of said large shell;

a small drum head, said small drum head being disposed over the end of said small shell;

a small head rim, said small head rim being disposed over said small drum head and being affixed to the end of said small drum shell by fastening means connected to the lip portion of said small shell; and a shoulder strap attaching hooks, said shoulder strap attaching hooks being affixed to said large shell and small shell;

whereby said dual drum can be used in an ambulatory manner while blending two different drum tones during its operation.

* * * * *